United States Patent [19]

Gurol et al.

[11] 4,423,299

[45] Dec. 27, 1983

[54] TOUCH SENSITIVE TRANSPARENT SWITCH ARRAY

[75] Inventors: I. Macit Gurol, Seattle; Gary M. Bang, Edmonds, both of Wash.

[73] Assignee: John Fluke Mfg. Co., Inc., Everett, Wash.

[21] Appl. No.: 255,677

[22] Filed: Apr. 20, 1981

[51] Int. Cl.[3] ..... H01H 9/00; H01H 13/02

[52] U.S. Cl. ..... 210/159 B; 200/5 A

[58] Field of Search ..... 200/159 B, 5 A

[56] References Cited

U.S. PATENT DOCUMENTS

| | | | |
|---|---|---|---|
| 3,594,684 | 7/1971 | Miller | 200/159 B |
| 4,017,848 | 4/1977 | Tannas, Jr. | 340/365 R |
| 4,071,718 | 1/1978 | Harden | 200/159 B |
| 4,085,302 | 4/1978 | Zenk et al. | 200/159 B |
| 4,145,584 | 3/1979 | Otterlei | 200/5 A |
| 4,220,815 | 9/1980 | Gibson et al. | 200/159 B |
| 4,243,852 | 1/1981 | Larson | 200/159 B |
| 4,317,012 | 2/1982 | Itoh | 200/159 B |

FOREIGN PATENT DOCUMENTS

| | | |
|---|---|---|
| 2268342 | 11/1975 | France . |
| 2389217 | 11/1975 | France . |
| 2324108 | 4/1977 | France . |

OTHER PUBLICATIONS

"Touch Keyboard Using Liquid Crystal Material" IBM Technical Disclosure Bulletin; By E. G. Nassimbene; vol. 18, No. 1; 6/1975.

*Primary Examiner*—Willis Little

*Attorney, Agent, or Firm*—Christensen, O'Connor, Johnson & Kindness

[57] ABSTRACT

A transparent switch array is disclosed that includes a relatively flexible or pliant sheet having a number of vertically-extending conductive column elements mounted in spaced apart parallel relationship with a relatively rigid backplate that includes a number of horizontally extending conductive row elements so that the intersecting row and column elements, in effect, form a matrix of rectangular touch-pressure activated switches. A relatively thin, flat electrical cable that is interposed between two edge regions of the backplate and the flexible sheet provides a portion of the peripheral backplate-flexible sheet spacing, with thin adhesive strips establishing the interelement spacing along the other two border regions. An array of small transparent elastomeric dots or beads that are deposited on one surface of the pliant sheet in effect outline the individual switch elements and maintain the pliant sheet in non-contacting, closely spaced orientation with the backplate. Compressive U-shaped spring clips, spaced along the periphery of the switch array, maintain the components in proper position and ensure good electrical contact between the conductive row and column elements and solderless connections between the electrical cable and the conductive elements of the backplate and the flexible sheet.

27 Claims, 5 Drawing Figures

TOUCH SENSITIVE TRANSPARENT SWITCH ARRAY

BACKGROUND OF THE INVENTION

This invention relates to touch-operated switching devices. More specifically, this invention relates to rectangular arrays of pressure sensitive switching elements that are relatively transparent and thus permit various alphanumeric characters or other symbols to be viewed through the switching array.

The type of switching array addressed by the present invention includes a relatively pliant or flexible planar sheet of material that is spaced apart from and parallel to a relatively rigid planar backplate of substantially identical curvature. To define a desired array of n rows and m columns of switching elements, the surface of the backplate that faces the pliant sheet material includes n parallel strips of conductive material and the juxtaposed surface of the pliant sheet includes m conductive strips that are parallel to one another and perpendicular to the conductive strips of the backplate. With this configuration, the application of pressure that sufficiently deforms or flexes the pliant sheet toward the backplate will cause one of the conductive strips on the pliant sheet to contact one of the conductive strips on the backplate. Since the parallel spaced conductors of the backplate and pliant sheet can be considered to correspond to the rows and columns of the rectangular switching matrix and are easily defined in terms of an orthogonal rectangular coordinate system (Cartesian coordinate system), switching devices of this type are sometimes referred to as X-Y switching arrays or X-Y selectors.

Prior art X-Y selectors and other arrays of touch-operated switches often serve as a keyboard for use with a wide variety of electrical and electronic systems wherein human control or interaction is necessary. In this regard, there are a growing number of situations in which it is either desired or necessary to change the function or operation defined by one or more keys within such a switching array during a particular sequence of keyboard operations or to change functions of the keys so that a completely different operational sequence can be implemented. For example, such a keyboard can be used advantageously in a programmed electronic instrument or system wherein operator interaction is required to sequence the system or instrument through a series of various computational steps or other operations that may vary, depending on the keys selected by the operator and/or the results of the previous step of the sequence.

In many instruments and systems of the above-described type, the number of switching elements required during each step of an operational sequence often varies and it may be desirable to utilize a different keyboard pattern or configuration at different steps of the sequence. In addition, to minimize the training and level of skill necessary to operate such an instrument or system, it is often desirable to visually present instructions or other information to the operator at each step of the sequence that requires operation of one or more keys.

One prior art proposal for permitting various instructions and comments to be displayed within an associated set of keys or switches that are defined in accordance with the operational step or sequence being performed utilizes an X-Y selector of the above-described type that is mounted to the face of a cathode-ray tube (CRT) or a similar display device with the pliant sheet, the backplate and the conductive strips all being formed of a transparent material. Since numerous techniques are known for generating virtually any desired symbol or character with either raster scan systems (such as conventional television) or X-Y deflectable electron gun systems (such as conventional oscilloscopes) and since most systems or instruments that include computational or programming capability can store the information required to generate a relatively large number of various displays, such an arrangement offers considerable advantages.

Prior to this invention transparent switch arrays have not proven totally satisfactory in the above-discussed arrangements and have exhibited one or more distinct disadvantages or drawbacks. For example, in one prior art device a relatively thick rectangular frame that borders the viewing area of the associated cathode-ray tube is used to separate a relatively thin, transparent sheet that includes several columns of conductive material from a rigid transparent backplate that includes several rows of conductive material. Even with the frame member providing a substantial separation between the transparent sheet and the backplate, sag or stretching of the transparent sheet sometimes occurs to the extent that conductive row and column elements come into contact with one another without being intentionally activated. Moreover, when the separation or gap between the adjacent conductive row and column elements is minimized so as to provide as large a number of switches as possible, such prior art devices often permit more than one conductive row and column element to come into contact so that ambiguous or false switching signals are generated. Both of these problems generally increase with switch usage and can be affected by environmental conditions such as temperature and humidity. Thus, equipment using such a transparent switch array often has generated a considerable number of field complaints and the switch arrays generally have had a relatively short service life.

Another factor that has contributed to the relatively short lifetime of most prior art transparennt switch arrays and also has resulted in various other disadvantages and drawbacks is the structural complexity of such devices. For example, in the above-mentioned prior art device which employs a rectangular frame for spacing the conductive elements apart from one another, electrical connection to each conductive column and row is provided by metal eyelets that are installed in the terminal region of the conductive strips with wires being inserted into and soldered to the eyelets. Because of space limitations, each wire that connects to a conductive strip of the pliant member must pass through an individual hole in the border region of the rigid backplate. Thus, considerable time is required to fabricate the various components and assemble such a device. Moreover, because at least the soldered connections to the pliant member must be removed before such a switching array can be disassembled, it is generally not practical to attempt to repair such a prior art device by, for example, replacing the pliant member.

In addition to the above-discussed problems, prior art devices have not always allowed the characters generated on the cathode-ray tube to be observed as readily as is desired. For example, to provide good viewing characteristics, the switching array must not diffuse or distort the characters produced on the cathode-ray tube. Further, to permit the display generated by the cathode-ray tube to define different switching formats that use a selected number of the arrayed switches at selected positions within the rectangular matrix that forms the switch array, the separation between the rows and columns (and hence between the switching elements) should be as visibly indiscernible as possible. Although materials of sufficient transparency are available, the visual or optical properties of prior art devices have not been completely satisfactory. For example, in prior art devices wherein the pliant member is spaced apart from the backplate by a fairly substantial distance, some distortion of the characters generated by the cathode-ray tube occurs and parallax may be a problem. Moreover, in many situations the equipment employing the switch array and cathode-ray display is operated under relatively high ambient lighting conditions wherein observation of the displayed characters or symbols becomes somewhat difficult. In such situations, various optical properties of prior art switch arrays such as lack of a high transmissibility at the wavelength of the luminescent display and high reflectivity of the pliant sheet material has caused additional degradation in the quality of the display.

Accordingly, it is an object of this invention to provide a relatively transparent switch array that can be utilized in conjunction with a cathode-ray tube or other type of display device to generate various switching formats and configurations.

It is another object of this invention to provide a transparent switch array wherein the backplate and the pliant member are closely spaced so that the assembled switch array is relatively thin and exhibits good optical properties.

It is still another object of this invention to provide a relatively transparent switch array that exhibits improved viewing of luminescent displays under various ambient lighting conditions relative to the quality of such displays in the absence of the switch array.

Even further, it is an object of this invention to provide a transparent switch array of the above-described type that is relatively simple to fabricate and repair to thereby provide a device that can be manufactured and maintained at a reasonable price.

SUMMARY OF THE INVENTION

In accordance with this invention, one surface of a relatively transparent, rigid backplate formed of poly(methyl methacrylate)-type polymer or other suitable material is coated with a thin, transparent conductive material such as a gold-titanium thin film. The conductive film is partitioned into a series of conductive row elements by scribing or otherwise removing a narrow region of material so as to electrically isolate each row element from the adjacent row elements. For example, in the presently-preferred method of manufacturing the invention, a grid of parallel, spaced apart conductors of relatively small diameter is placed against the coated surface of the backplate and an electrical current is applied to, in effect, burn away narrow regions of the thin film coating and form the desired row elements.

Conductive column elements that form the second element of each switch of a switch array of this invention are formed in a similar manner on one surface of a sheet of polyester or other transparent material that exhibits a pliancy or yielding characteristic that permits at least limited deformation or flexure when a localized pressure such as the force exerted by pressing lightly with a finger is asserted against the surface of the material. In accordance with the invention, this pliant sheet material is positioned parallel to and spaced apart from the coated surface of the backplate with the conductive column elements facing the backplate and being substantially perpendicular to the row elements on the surface of the backplate. As compared to prior art devices of similar structure, the backplate and the pliant member of each embodiment of this invention are relatively close together, being spaced apart by a distance of less than 0.010 inch (254 microns) and preferably being spaced apart by a distance of approximately 0.8 to 1.2 mils (20 to 30 microns).

To support the conductive surfaces of the backplate and the pliant member in noncontacting juxtaposition with one another, the surface of the pliant sheet includes a geometric pattern of transparent bead-like "dots" with each dot projecting outwardly from the conductive surface of the material. More specifically, in the presently-preferred embodiments of the invention, small dots of a transparent, silicon-based elastomer are deposited on the surface of the pliant material by means of a conventional silk-screen process with the dots forming a rectangular pattern that corresponds to the pattern formed by the narrow gaps that separate adjoining conductive elements of the backplate from one another and the narrow gaps that separate column elements of the pliant sheet from one another. To make the dots as visually indiscernible as possible, the material for forming the separation dots is selected to obtain a diffraction coefficient that is approximately equal to the square root of the diffraction coefficient of the pliant sheet member. Moreover, a minimum number of separation dots is employed, with the presently-preferred embodiments of invention utilizing four such dots symmetrically positioned about each intersection of the juxtaposed narrow gaps that defines the corners of four contiguous switching elements. In such an arrangement, the rectangular outline of each touch sensitive switch region of the array includes eight separation dots with two dots being associated with any one edge.

Electrical contact is provided to each conductive row and column element by means of small spaced apart conductors that are formed on one surface of a thin, flexible strip of a substrate material such as a polyester film or polyimide sheet material. The terminal portion of each conductor of this electrical cable arrangement includes a rectangular contact region positioned so that each contact region of the cable will contact the terminal portion of an associated conductive row element when the cable is placed on the conductive surface of the backplate and routed along an edge that is perpendicular to the conductive row elements. To contact the conductive column elements of the pliant sheet with an additional series of contact regions that are formed on the surface of the electrical cable, the cable is folded on itself at one corner of the backplate so that the cable extends along one of the backplate edges that is parallel to the conductive row elements. This causes the conductive regions of the cable of face upwardly for contacting the terminal portions of the conductive column elements that are contained on one surface of the pliant sheet member.

In the disclosed embodiments of the invention, the electrical cable is maintained in the above-described position by a strip of thin, transparent material having an adhesive material deposited on each planar surface thereof. A strip of this double-sided adhesive material is then applied to the border region of the two remaining edges of the backplate and the pliant sheet is positioned atop the border formed by the electrical cable and the adhesive strips. The sandwich-like assemblage is then joined together by U-shaped spring clips that are installed along the edges of the assembly, with a clip being positioned over each contact region of the electrical cable and the juxtaposed terminal region of the associated row or column element. In accordance with the invention, no other fasteners or adhesive materials are required since the compressive force exerted by the U-shaped spring clips maintains satisfactory electrical contact between the cable and the conductive row and column elements while also imparting the necessary degree of structural integrity to the assembled switch array.

In accordance with another aspect of this invention, the conductive film that forms the row elements of the backplate and the column elements of the pliant sheet member is selected and arranged for substantially improved view of luminescent displays that are generated at the rear surface of the backplate by conventional cathode-ray systems, or other devices such as liquid-crystal displays and plasma-discharge display panels. In this regard, most display materials exhibit a relatively high degree of photoluminescence as well as being energizable by a primary excitation means and viewing the display under conditions of relatively high ambient light can become a problem. For example, the disclosed embodiment of the invention is configured for use with a cathode-ray tube wherein the phosphor compound that coats the inside surface of the tube face is excited by an emitted electron beam (cathode luminescence) and light energy that impinges on the gloss face of the tube further excites the pbosphorescent coating (photoluminescence). Under some ambient light conditions the photoluminescence can seriously hamper observance of the intended display, especially in situations wherein the display primarily depends on phosphorescence of the display material, rather than the fluorescence thereof (i.e., the cathode ray tube utilizes a "high persistence" phosphorescent coating).

To substantially improve the quality of such displays the conductive coating of the switch array is selected to exhibit high transmissibility (transparency) relative to the light energy emitted by the luminescent display and high opacity (low transparency) relative to light energy that causes the photoluminescence. Thus, the coating or film of the preferred embodiments of the invention are, in effect, optical filters which improve the display quality while simultaneously providing the necessary electrical conductivity and durability. For example, in the disclosed embodiment of the invention, conductive films that employ an initial layer of titanium dioxide that is approximately 75 to 150 angstroms in thickness; a second layer of sputter gold that is approximately 40 to 120 angstroms thick; and a surface layer of tin-indium oxide that is approximately 150–500 angstroms in thickness provide the desired electrical conductivity and optical filtering for a cathode-ray phosphorescent material that emits light at a primary wavelength of approximately 520 nanometers.

BRIEF DESCRIPTION OF THE DRAWING

Other objects and advantages of the present invention will become apparent to one skilled in the art after reading the following description taken together with the accompanying drawing in which.

DETAILED DESCRIPTION

Figure 1:
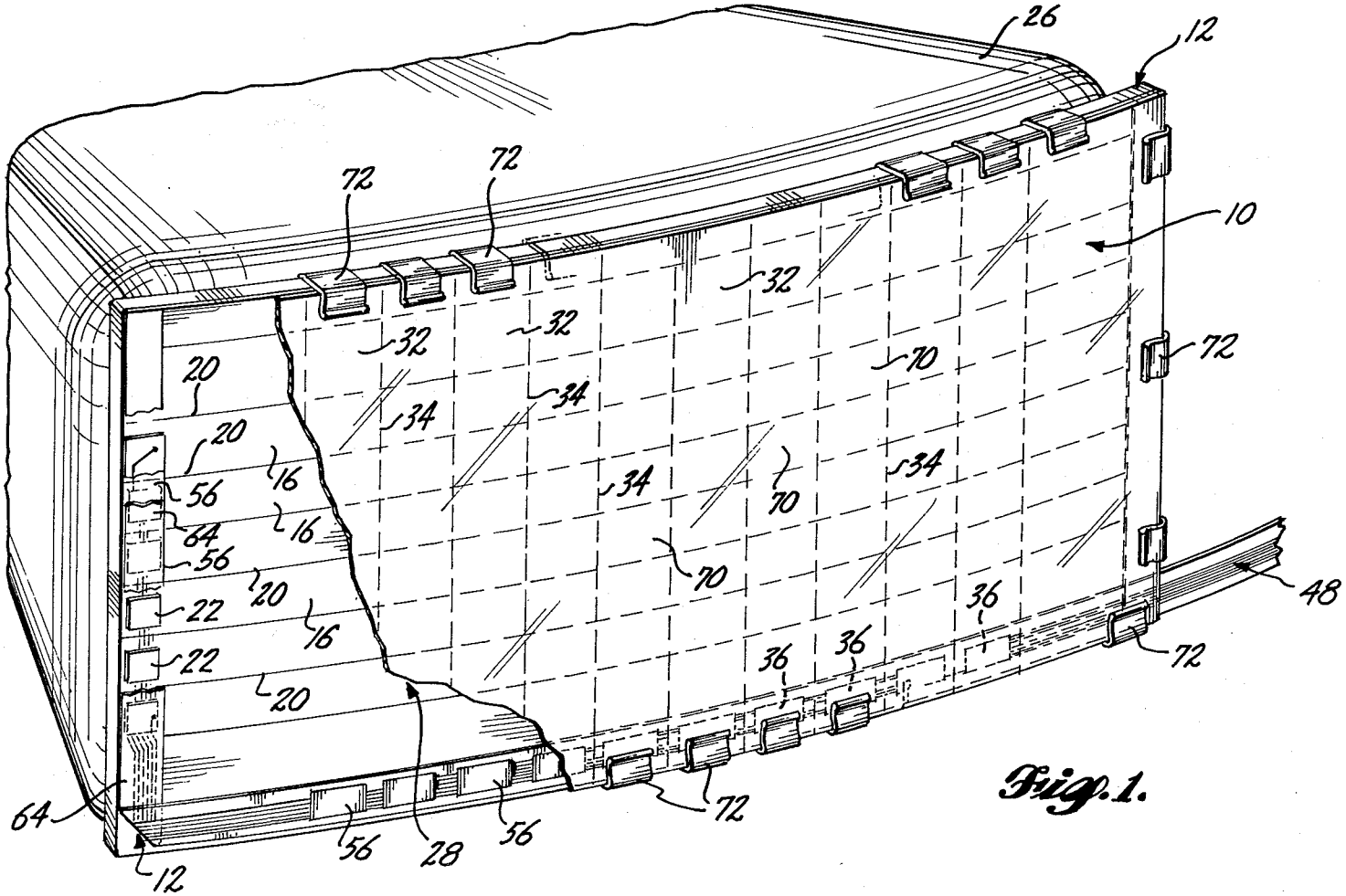
FIG. 1 is a partially cutaway perspective view of a transparent switch array constructed in accordance with this invention that is positioned on the face of an associated cathode-ray tube.

Referring collectively to FIGS. 1 through 5, a switch array constructed in accordance with this invention (generally denoted by the numeral 10 in the FIGURES) includes a planar, transparent backplate 12 having a transparent conductive coating 14 that forms a number of conductive strip regions 16 on the backplate upper surface 18. In the depicted arrangement, the conductive strips 16 extend longitudinally across the upper surface 18 of backplate 12 to form conductive row elements that are electrically isolated from one another by narrow strips or gaps 20 in the conductive coating 14. Rectangular metal contact regions 22 are formed in the terminal portion of each conductive strip 16 so that the contact regions 22 are within a vertically-extending border region that is outside the viewing area when the transparent switch array 10 is positioned against the face of an associated display device such as the cathode-ray tube 26 that is shown in FIG. 1. In this regard, the curvature of backplate 12 is established to match that of the face of the cathode-ray tube 26 and, if desired, a thin pliant gasket (not shown in the drawings) can be mounted between the rear surface of the switch array 10 and the front surface of cathode-ray tube 26.

A relatively flexible or pliant sheet 28 that is of substantially the same shape and size as backplate 12 includes a transparent conductive coating 30 for forming a number of vertically-extending conductive strips 32. The conductive strips 32 are generally referred to as column elements and are electrically isolated from one another by narrow strips or gaps 34. Each conductive strip 32 includes a rectangular contact region 36 that is formed in a horizontally-extending edge region that lies outside the viewing region of the associated cathode-ray tube 26.

In the presently-preferred embodiments of the invention, backplate 12 is formed of a transparent, thermoplastic acrylic-type material such as a poly-(methyl methalcrylate)-type polymer that is available under the trademark Plexiglas. Generally, backplate 12 is approximately 0.030 inch to 0.10 inch in thickness (760 to 2500 microns). Pliant sheet 28 is preferably constructed of a transparent polyester film such as the various films that are sold under the trademark, Mylar, and is preferably aproximately four to five mils thick (10 to 13 microns).

The backplate conductive coating 14 and the pliant sheet conductive coating 30 are preferably on backplate 12 and pliant sheet 28 by conventional thin film deposition techniques such as cathode sputtering with the materials employed and the film thicknesses being selected so as to meet various physical, electrical and optical requirements. In this regard, the conductive coatings 14 and 30 must exhibit a relatively high electrical conductivity in order to perform the desired switching function and, because of flexure and frictional contact that is experienced during the switching operations, must adhere well to backplate 12 and pliant sheet 28 while simultaneously exhibiting a relatively hard, durable surface that will not rapidly deteriorate due to frictional contact. Moreover, although coatings 14 and 30 must be transparent to radiation at wavelengths associated with the luminescent display (e.g., the display generated on the face of cathode-ray tube 26), coatings 14 and 30 are preferably configured to exhibit a relatively high opacity to longer wavelength radiation (e.g., radiation in the ultraviolet portion of the spectrum). Thus, coatings 14 and 30 cause switch array 10 to exhibit an optical filtering characteristic that reduces radiation that would otherwise result in photoluminescence that, in effect, reduces the contrast between the displayed characters and background regions.

Figures 2, 3:
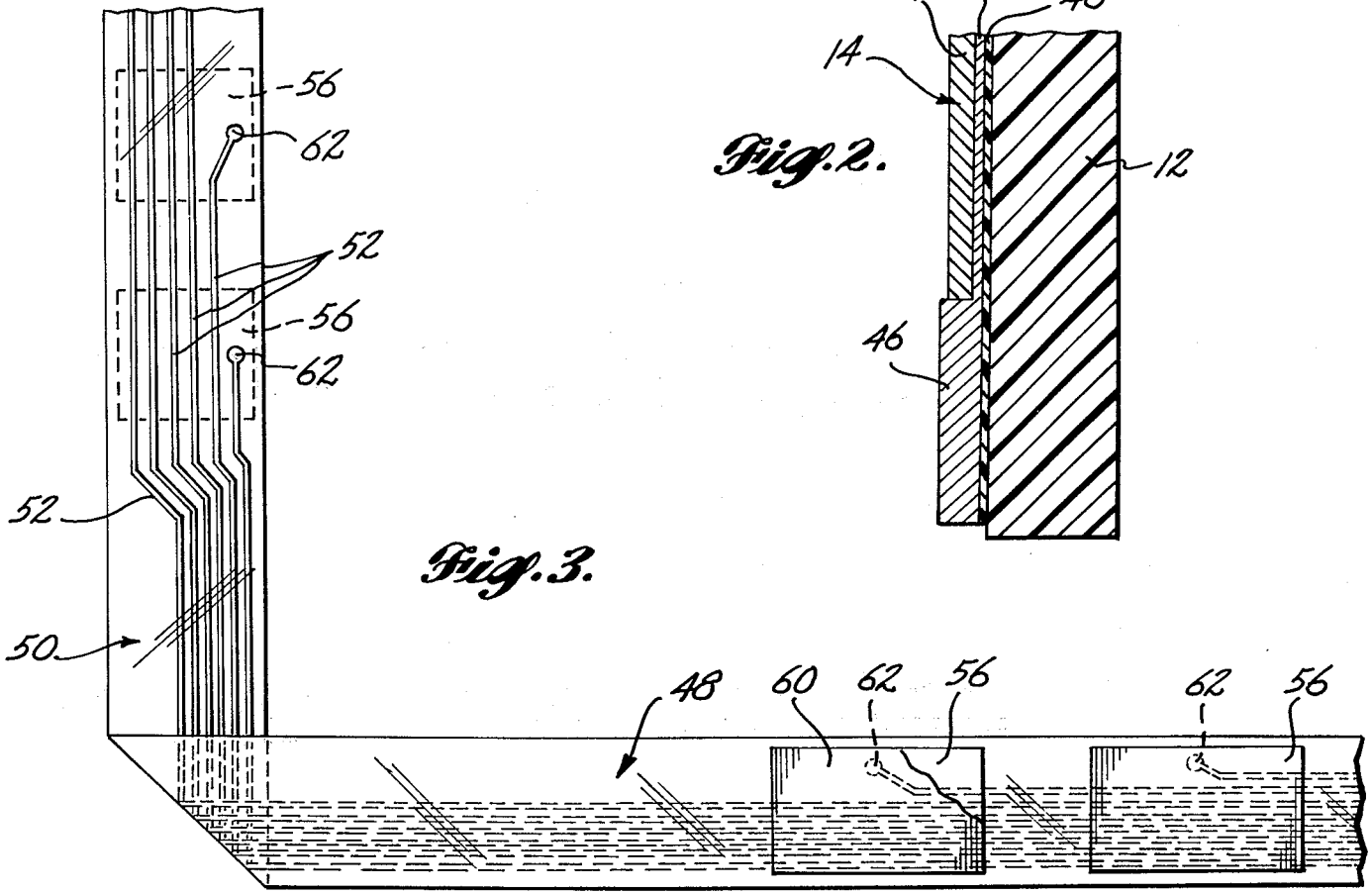
FIG. 2 is a cross-sectional view of a portion of the transparent backplate of the switching array of FIG. 1 which illustrates the manner in which the transparent conductive coatings and the electrical contact regions are formed.
FIG. 3 is an enlarged view of the electrical cable assembly that is utilized in the switch array of FIG. 1.

To meet the above-mentioned electrical, mechanical and optical objectives, the disclosed embodiment of the invention employs a multilayer thin film structure of the type depicted in FIG. 2, which illustrates a portion of backplate 12 and conductive coating 14. In the depicted arrangement the first layer 40 is a material such as titanium dioxide or tin-indium oxide that substantially improves the adherence of a second layer 42 of a highly conductive metal such as gold, silver, platinum or palladium. The surface layer 44 forms the relatively durable surface of the conductive coatings 14 (and 30) and is formed of tin-indium oxide.

As is known in the art, the exact conductance of a multilayer thin film structure cannot be theoretically predicted, but depends on a number of factors such as the conductivities of the various materials employed, the solid solution and multiphase alloying characteristics of such materials, the type of thin film deposition techniques employed (e.g., evaporation, plating, or sputtering) and, even when limited to sputtered films, depends on system parameters such as the sputtering atmosphere, energy of the sputtered particles and the surface characteristics of the substrate material. In a similar manner, optical properties (e.g., transparency or transmissibility) of multilayer or alloyed thin films cannot be predicted with a high degree of certainty. Thus, selection of the most advantageous conductive coating 14 and 30 often requires a certain amount of empirical testing to determine the thickness of each of the layers 40, 42 and 44 and, in some cases, on which material (gold, silver, platinum or palladium) is best used as the highly conductive second layer 42.

More specifically, since a wide range of thickness of the abovenoted materials will result in a satisfactory conductance value and use of a sufficiently thick surface layer 44 of tin-indium oxide (usually at least 100 angstroms) ensures sufficient surface durability, the conductive coatings 14 and 30 are often selected to achieve the desired optical filtering characteristics. In this regard, conductive coatings 14 and 30 ideally result in a relatively high opacity of switch array 10 for spectra of a wavelength greater than that exhibited by the luminescent display characters and result in a high level of transparency for radiation emitted by the luminescent display. For example, in one embodiment that is configured for operation with a cathode-ray tube wherein the wavelength of the primary frequency of the luminescent display is approximately 520 nanometers, the first layer 40 consists of approximately 70–200 angstroms of titanium dioxide; the second layer 42 consists of approximately 40–150 angstroms of gold and the tin-indium oxide surface layer 44 is approximately 100–200 angstroms thick. To configure switch array 10 for optimal optical filtering with a display device that limits higher frequency radiation, silver, platinum or palladium would be considered for use as the highly conductive second layer 42 and experiments would be conducted to determine the optimal thickness range for each layer of the coatings 14 and 30.

Regardless of the exact configuration of coatings 14 and 30, electrical contact to each conductive strip 16 of backplate 12 and each conductive strip 32 of pliant sheet 28 of the depicted embodiment of the transparent switch array 10 is provided by a thin, flat electrical cable assembly 48. As is illustrated by FIG. 1, electrical cable 48 is routed along the vertically-extending border region of backplate 12 that includes rectangular contact regions 22 and is routed along the lower boundary of backplate 12 so as to be juxtaposed with the lower horizontal border region and contact regions 36 of pliant sheet 28 when the pliant sheet 28 is positioned in front of and spaced apart from backplate 12 in the manner depicted in FIG. 1. With particular reference to FIG. 3, electrical cable assembly 48 includes a relatively thin, flexible substrate layer 50 that is formed of a plastic material such as polyester film or a polyimide sheet material. Parallel, spaced apart electrical conductors 52 run along one surface of the substrate 50 with a conductor being provided for each row element included on backplate 12 and each column element included on pliant sheet 28. As is shown most clearly in FIG. 3, a plurality of rectangular contacts 56 that substantially correspond in geometry and spacing with backplate contacts 22 and pliant sheet contacts 36 are formed on the second planar surface of cable substrate 50. More specifically, the cable contacts 56 are positioned and arranged to be in contacting juxtaposition with the row element contacts 22 of backplate 12 when cable assembly 48 is positioned along a vertically-extending border region of backplate 12 in the manner illustrated in FIG. 1. Since the cable assembly 48 is folded on itself so that cable assembly extends horizontally along the lower boundary region of backplate 12, the surface of cable substrate 50 which includes electrical contact regions 56 faces the portion of pliant sheet 28 that includes the column contacts 36. Thus, electrical cable contacts 56 that are located along the lower portion of backplate 12 are placed in contacting juxtaposition with pliant sheet column contacts 36 when pliant sheet 28 is mounted to backplate 12 in the manner illustrated in FIG. 1.

Although cable assembly 48 can be fabricated by employing various conventional techniques such as the photolithographic and etching or plating techniques used to realize small printed circuits and/or the conductors employed in silicon-thin film or thick film hybrid circuits, each cable contact region 56 preferably includes a gold surface layer 60 that ensures a reliable electrical contact with the associated contact region 22 or 36. As is indicated in FIG. 3, interconnection between each cable contact region 56 and an associated one of the electrical cable conductors 52 is effected by, for example, a "plated-through hole" 62 that extends between the oppositely disposed surfaces of cable substrate 50.

As is indicated in FIG. 1, a thin transparent strip 64, having an adhesive material coated on both planar surfaces thereof, is routed along the surface of electrical cable assembly 48 that does not include the conductive contact regions 56. Thus, because of the above-discussed folded configuration of cable assembly 48, the adhesive strip 64 attaches cable assembly 48 to the lower border region of backplate 12 and loosely bonds the vertically extending portion of cable assembly 48 to one vertical border region of pliant sheet 28. Since the adhesive strip 64 is also used to fasten pliant sheet 28 to backplate 12 along vertical and horizontal regions that do not include electrical cable assembly 48, it can be recognized that the spacing between the juxtaposed backplate 12 and the pliant sheet 28 is not uniform around the entire periphery of switch array 10. In this regard, the presently preferred embodiments of the invention employ a cable assembly 48 that is approximately three mils (75 microns) thick with the adhesive strip 64 being approximately 1½ mils (38 microns) thick. Because of the above-described folded configuration of electrical cable 48, the spacing between the conductive surface of backplate 12 and the conductive surface of pliant sheet 28 of such an embodiment may be on the order of seven to eight mils in the corner region of switch array 10 that includes the folded portion of electrical cable 48. On the other hand, portions of the switch array border regions that extend outwardly from the folded portion of electrical cable 48 will typically exhibit a backplate-compliant sheet spacing of approximately 4 to 6 mils (100 to 150 microns) and the backplate-compliant sheet spacing along the border regions 24 and 38 that are separated only by the adhesive strip 64 is typically on the order of 1½ to 2 mils (37 to 50 microns).

Although thin spacers and undercutting or machining a portion of backplate 12 could be employed to provide more uniform peripheral spacing between pliant sheet 28 and backplate 12, such measures do not appreciably improve either the structural integrity or the operation of this invention. In this regard, the two most important criteria are that the conductive regions of backplate 12 and pliant sheet 28 do not contact one another unless pliant sheet 28 is deformed by pressing it toward backplate 12 and that a region of pliant sheet 28 that contains a conductive strip 32 and is urged into contact with the conductive surface of backplate 12 contacts only the oppositely disposed conductive strip 16 of backplate 12.

Figure 4:
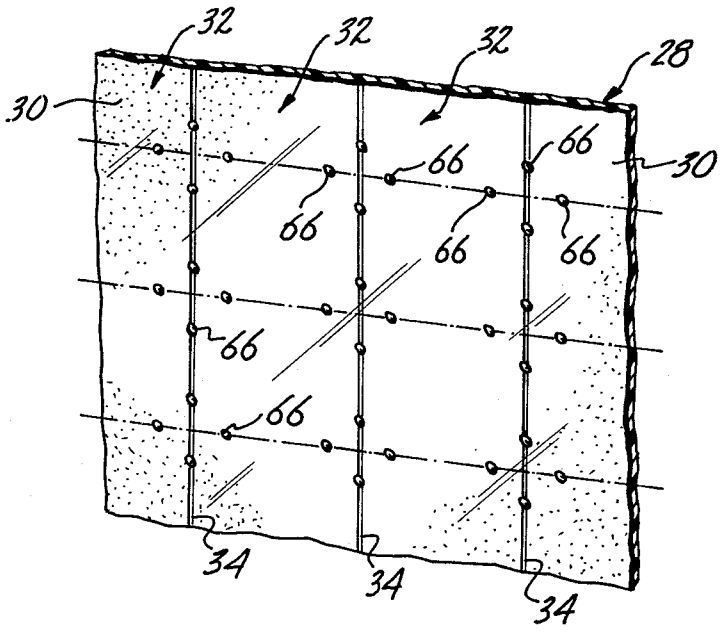
FIG. 4 is an enlarged view of a portion of the pliant sheet member of the switch array of FIG. 1 which illustrates a geometric pattern of beads or "dots" that are formed on one surface of the pliant sheet to prevent inadvertent electrical contact between the conductive regions of the pliant sheet and the conductive regions of the backplate.
Figure 5:
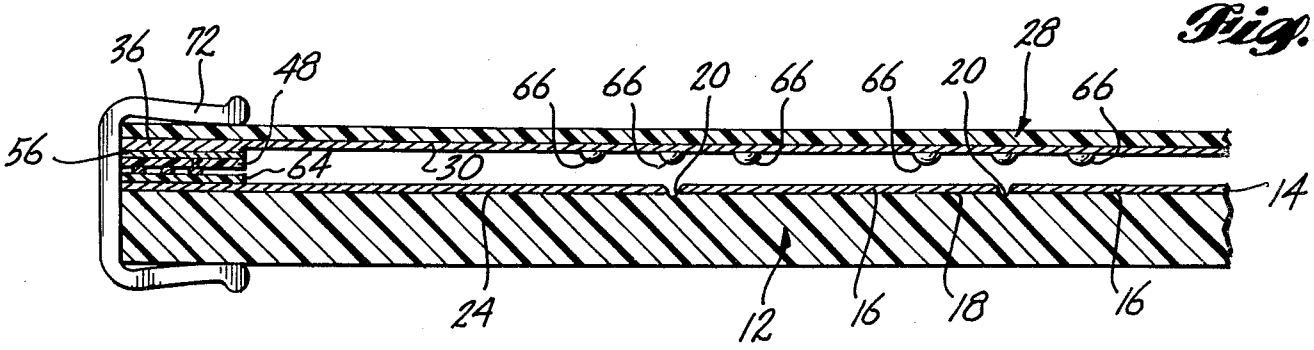
FIG. 5 is a partial cross-sectional view of the switch array that illustrates the manner in which the embodiment of the invention depicted in FIG. 1 is assembled.

To prevent inadvertent electrical contact between conductive regions of pliant sheet 28 and backplate 12 and to more effectively subdivide the switching array into a matrix of small rectangular pressure sensitive switches that correspond to the spatial regions defined by the intersecting backplate gaps 20 and the pliant sheet gaps 34, the conductive surface of pliant sheet 28 includes an array of small transparent beads or "dots" 66 that are somewhat hemispherical in shape. In particular, and as is illustrated in FIGS. 4 and 5, the presently preferred embodiments of the invention include four dots that are deposited on the surface of pliant sheet 28 and form a substantially symmetric pattern about the intersection between a gap 34 that separates the conductive strips 32 of pliant sheet 28 and a gap 20 of backplate 12. Thus, as is depicted most clearly in FIG. 4, each gap 34 of pliant sheet 28 includes a series of spaced apart dots 66 wherein each pair of consecutive dots are substantially equidistant from an orthogonal trace 68 that aligns with a gap 20 of backplate 12 when the switch array is assembled in the manner depicted in FIG. 1. In this arrangement, an additional series of dots is formed on each trace 68 that extends across the conductive surface of pliant sheet 28, with each pair of consecutive dots along a trace 68 being positioned so that each dot thereof lies on trace 68 and is substantially equidistant from two dots that are deposited in a gap 34. As can be seen in both FIGS. 1 and 4, the above-discussed dot pattern of the presently preferred embodiments, in effect, defines a matrix of rectangular touch regions 70 wherein the periphery of each touch region includes eight dots 66 (two per side).

In the above-discussed presently preferred embodiments of the invention, the dots 66 are approximately 0.8 to 1.25 mils in diameter (20 to 32 microns) and project outwardly from the surface of pliant sheet 28 so as to maintain a backplate to pliant sheet spacing of approximately 0.8 to 1.25 mils (20 to 32 microns). To form the dots 66, an organo-silicon based elastomer is applied to the surface of pliant sheet 28 by means of a silk-screen (not shown in the drawing) which includes open weave areas that define the desired geometric dot pattern. Regardless of the exact pattern and technique employed, the material utilized should cure at a relatively low temperature (e.g., room temperature) to form flexible transparent beads or dots and should be selected for satisfactory adherence to both the conductive coating 30 and the gap regions 34 of pliant sheet 28. Moreover, to ensure that the overall arrangement is as transparent as possible (i.e., to provide dots 66 that are as visually indiscernible as possible), the diffraction coefficient of the organo-silicon elastomer should be substantially equal to the square root of the diffraction coefficient of pliant sheet 28.

One material that has proven satisfactory in the practice of this invention is an organo-silicon material that is marketed by Dow Corning Corporation of Midland, Mich. under the product identification DC3440. In utilizing this material sufficient xylene is added to produce the paste-like consistency required for optimum silk-screening. Although solvents other than xylene may be satisfactory, it has been found that the xylene acts as somewhat of an etchant relative to the polyester film utilized to fabricate pliant sheet 28 and thereby improves the bond between pliant sheet 28 and the dots 66. Moreover, xylene appears to increase the air cure time of the elastomer being employed, thereby improving the "pot-life" of the material and permitting batch processing techniques to be employed.

As is illustrated in both FIGS. 1 and 5, the pliant sheet 28 is assembled to backplate 12 without the use of conventional fasteners or permanent bonding techniques and the contact regions 56 of cable assembly 48 are not soldered or otherwise joined to the abutting backplate contact regions 22 and pliant sheet contact regions 36. In this regard, and as previously described, the surface of electrical cable assembly 48 which is oppositely disposed to the surface that includes the contact regions 56 is affixed to the facing regions of backplate 12 and pliant sheet 28 only by means of adhesive strip 64. A series of U-shaped spring clips 72, preferably formed of metal strip material of a width that is commensurate with the width of the rectangular contact regions 22, 36 and 56, are installed along the periphery of the switching array to maintain the components in the proper orientation and to ensure satisfactory electrical contact between electrical cable 48 and the conductive row and column elements of backplate 12 and pliant sheet 28. In this regard, a spring clip 72 is placed over each edge region of switch array 10 that includes a pair of the contacts 22, 36 and 56 to, as is shown in FIG. 5, exert compressive force that urges the contact regions against one another so as to maintain satisfactory electrical contact. Additional spring clips 72 are spaced along the remaining periphery of the switch array 10 as is required to secure pliant sheet 28 to backplate 12.

In manufacturing the above-described switch array 10, a sheet of thermoplastic material of the desired type is placed on a mold having a surface contour that corresponds to the desired contour of backplate 12 (i.e., the curvature of the face of the associated cathode-ray tube 26 in FIG. 1). The mold and the sheet material are then placed in an infrared oven and heated to a temperature at which backplate 12 assumes the curvature of the mold. Backplate 12 is then cleaned and a uniform coating of the previously-described type is deposited on one entire surface of the backplate by successive vacuum depositing (sputtering) of, for example, titanium dioxide, gold and tin-indium oxide of the previously-mentioned thicknesses. The thicker gold that defines the above-described backplate contact regions is then formed by continued sputtering or other low temperature deposition techniques. The conductive coating of pliant sheet 28 is formed in the same manner, without the necessity of molding the polyester film or other material employed to match the curvature of backplate 12 and the associated cathode-ray tube 26.

The conductive rows of backplate 12 and the conductive columns of pliant sheet 28 are then formed by placing the coating surfaces of backplate 12 and pliant sheet 28 against an array of thin, parallel wires. An electrical current is introduced in the wires so that the wires attain a temperature that removes the conductive coating from the contacting regions of backplate 12 and pliant sheet 28. Although other methods such as scribing can be employed to form the backplate gaps 20 and pliant sheet gaps 34 that define conductive strips 16 and 32 of backplate 12 and pliant sheet 28, the above-mentioned method produces very thin gaps that are relatively indiscernible.

The backplate 12, pliant sheet 28 and electrical cable 48 are then assembled in the manner discussed relative to FIG. 1 and the U-shaped spring clips 72 are installed.

It should be recognized that the invention is described herein in terms of the presently preferred embodiments and various alterations and modifications can be made without exceeding the scope and the spirit of the invention. For example, the practice of the invention is not limited to use with the cathode-ray tube display discussed herein in that the switch array can readily be configured for use with variously-contoured display devices that utilize liquidcrystal displays, gas-discharge displays or virtually any type of luminescent character generation. Further although the dots 66 are described as being deposited on the pliant sheet 28, it may be advantageous to position the dots on the backplate 12 when, for example, the switch array is of relatively flat contour. Moreover, although the circular outline and semicircular shape of the dots 66 is generally advantageous because of the minimal surface area presented, different shapes and geometries can be used if desired. Even further, in embodiments that utilize relatively large conductive strips to form larger touch-pressure activated switches than those of the discussed embodiments may require the use of a dot pattern that includes additional dots 66 to prevent inadvertent contact between the conductive regions of the backplate and the pliant sheet. Because of the above potential changes and others that will be apparent to those skilled in the art, the extent of this invention is to be interpreted in view of the appended claims.

The embodiments of the invention in which an exclusive property or privilege is claimed are defined as follows:

1. A transparent switch array comprising:

a relatively transparent backplate having a first plurality of substantially parallel conductive strips formed on one surface thereof;

a relatively flexible transparent sheet having a second plurality of substantially parallel conductive strips formed on one surface thereof, said flexible sheet and said second plurality of strips being dimensioned and arranged for mounting of said flexible sheet in closely spaced apart, parallel relationship with said transparent backplate with said surface of said flexible sheet including said second plurality of conductive strips facing said surface of said backplate including said first plurality of conductive strips and with said second plurality of conductive strips being substantially perpendicular to said first plurality of conductive strips, said flexible sheet further including a plurality of bead-like regions formed on said surface of said pliant sheet that include said second plurality of conductive strips and extending outwardly therefrom, said plurality of bead-like regions being arranged in a pattern that positions a first portion of said plurality of bead-like regions between adjacent ones of the conductive strips of said second plurality of conductive strips and positions a second portion of said bead-like regions in alignment with the separation between adjacent ones of said first plurality of conductive strips when said flexible sheet is mounted in said parallel, closely spaced orientation with said backplate; and means for supporting and maintaining said flexible sheet in said parallel, closely spaced orientation with said surface of said backplate that includes said first plurality of conductive strips, said means for supporting and maintaining said flexible sheet in said parallel, closely spaced orientation with said backplate includes including a flat electrical cable having a plurality of substantially parallel spaced apart conductors extending along one planar surface thereof, said cable being interposed between at least two edge regions of said backplate and said flexible sheet, each of said conductors of said cable being arranged for electrically contacting a conductive strip within one of said first and second pluralities of conductive strips.

2. The transparent switch array of claim 1 wherein said substantially parallel spaced apart conductors of said electrical cable extend along the first planar surface thereof and the second planar surface of said electrical cable includes a plurality of spaced apart electrical contacts, each of said electrical contacts being electrically connected to one of said conductors; and, wherein individual ones of said electrical contacts of said electrical cable within a first portion of said electrical cable are positioned against individual conductive strips of said first plurality of conductive strips when said electrical cable is interposed between said backplate and said flexible sheet, said electrical cable including a second portion formed by folding said electrical cable on itself to cause the second portion thereof to extend orthogonally away from said first portion of said electrical cable with said electrical contacts within said second portion of said electrical cable being positioned against individual conductive strips of said second plurality of conductive strips of said flexible sheet.

3. The transparent switch array of claim 2 wherein said means for supporting and maintaining said flexible sheet in said parallel, closely spaced orientation with said surface of said backplate includes at least one section of relatively thin, flat strip for maintaining the spacing between peripheral regions of said backplate and said flexible sheet that are not separated by said electrical cable; said means for supporting and maintaining said pliant sheet in said parallel, closely spaced orientation with said backplate further including a plurality of U-shaped spring clips, said spring clips being installed at spaced apart locations along the periphery of said switch array with each said clip girding the edges of both said backplate and said flexible sheet to compressibly maintain said flexible sheet substantially parallel with and closely spaced to said backplate with said electrical cable and said sections of flat strip being interposed between the peripheral edges thereof.

4. The transparent switch array of claims 1, 2, or 3 wherein said plurality of bead-like regions of said pliant sheet are formed of a low temperature curing organo-silicon elastomer.

5. The transparent switch of claim 4 wherein said bead-like regions are deposited on said flexible sheet by means of a silk-screen process.

6. The transparent switch array of claim 5 wherein said organo-silicon elastomer is transparent and exhibits a coefficient of diffraction that is substantially equal to the square root of the coefficient of diffraction exhibited by said flexible sheet.

7. A transparent switch array comprising:

a relatively transparent flexible sheet having a first plurality of substantially parallel conductive strips formed on one surface thereof;

a relatively transparent backplate having a second plurality of substantially parallel conductive strips formed on one surface thereof, said backplate and said second plurality of strips being dimensioned and arranged for mounting of said flexible sheet in closely spaced apart, parallel relationship with said backplate with said surface of said flexible sheet including said first plurality of conductive strips facing said surface of said backplate including said second plurality of conductive strips and with said first plurality of conductive strips being substantially perpendicular to said second plurality of conductive strips, said backplate further including a plurality of bead-like regions formed on said surface of said backplate that include said second plurality of conductive strips and extending outwardly therefrom, said plurality of bead-like regions being arranged in a pattern that positions a first portion of said plurality of bead-like regions between adjacent ones of the conductive strips of said second plurality of conductive strips and positions a second portion of said bead-like regions in alignment with the separation between adjacent ones of said first plurality of conductive strips when said flexible sheet is mounted in said parallel, closely spaced orientation with said backplate; and means for supporting and maintaining said fexible sheet in said parallel, closely spaced orientation with said surface of said backplate that includes said first plurality of conductive strips, said means for supporting and maintaining said flexible sheet in said parallel, closely spaced orientation with said backplate includes a flat electrical cable having a plurality of substantially parallel spaced apart conductors extending along one planar surface thereof, said cable being interposed between at least two edge regions of said backplate and said flexible sheet, each of said conductors of said cable being arranged for electrically contacting a conductive strip within one of said first and second pluralities of conductive strips.

8. The transparent switch array of claim 7 wherein said substantially parallel spaced apart conductors of said electrical cable extend along the first planar surface thereof and the second planar surface of said electrical cable includes a plurality of spaced apart electrical contacts, each of said electrical contacts being electrically connected to one of said conductors; and, wherein individual ones of said electrical contacts of said electrical cable within a first portion of said electrical cable are positioned against individual conductive strips of said first plurality of conductive strips when said electrical cable is interposed between said backplate and said flexible sheet, said electrical cable including a second portion formed by folding said electrical cable on itself to cause the second portion thereof to extend orthogonally away from said first portion of said electrical cable with said electrical contacts within said second portion of said electrical cable being positioned against individual conductive strips of said second plurality of conductive strips of said flexible sheet.

9. The transparent switch array of claim 8 wherein said means for supporting and maintaining said flexible sheet in said parallel, closely spaced orientation with said surface of said backplate includes at least one section of relatively thin, flat strip for maintaining the spacing between peripheral regions of said backplate and said flexible sheet that are not separated by said electrical cable; said means for supporting and maintaining said pliant sheet in said parallel, closely spaced orientation with said backplate further including a plurality of U-shaped spring clips, said spring clips being installed at spaced apart locations along the periphery of said switch array with each said clip girding the edges of both said backplate and said flexible sheet to compressibly maintain said flexible sheet substantially parallel with and closely spaced to said backplate with said electrical cable and said sections of flat strip being interposed between the peripheral edges thereof.

10. The transparent switch array of claims 7, 8, or 9 wherein said plurality of bead-like regions of said pliant sheet are formed of a low temperature curing organo-silicon elastomer.

11. The transparent switch of claim 10 wherein said bead-like regions are deposited on said flexible sheet by means of a silk-screen process.

12. The transparent switch array of claim 11 wherein said multilayer thin film structure includes a surface layer of tin-indium oxide, a second layer of gold and a bottom layer of titanium dioxide.

13. The transparent switch array of claim 12 wherein said tin-indium oxide layer is approximately 150 to 500 angstroms in thickness, said gold layer is approximately 40 to 120 angstroms in thickness and said titanium dioxide layer is approximately 75 to 150 angstroms in thickness.

14. The transparent switch array of claim 11 wherein said organo-silicon elastomer is transparent and exhibits a coefficient of diffraction that is substantially equal to the square root of the coefficient of diffraction exhibited by said flexible sheet.

15. The transparent switch array of claim 7 wherein said switch array is positionable on the face of a display device for generating luminescent display characters and the thickness and materials utilized in said multilayer thin film structure are selected to provide relatively high transparency at radiation wavelengths associated with said luminescent display characters and to provide relatively higher opacity at longer wavelengths.

16. A transparent switch array for mounting on the face of a display device that generates luminescent display characters, said transparent switch array comprising:

a relatively transparent backplate having a first plurality of substantially parallel conductive strips formed on one surface thereof, each of said substantially parallel conductive strips being a multilayer thin film structure including a surface layer of tin-indium oxide, a second layer of an electrically conductive material and a bottom layer of material that causes such layer to adhere to said surfaces of said backplate and said flexible sheet, said multilayer thin film structure exhibiting higher transmittance at radiation wavelengths associated with said luminescent display than is exhibited at longer wavelengths;

a relatively flexible transparent sheet having a second plurality of substantially parallel conductive strips formed on one surface thereof, each of said substantially parallel conductive strips being a multilayer thin film structure including a surface layer of tin-indium oxide, a second layer of an electrically conductive material and a bottom layer of material that causes such layer to adhere to said surfaces of said backplate and said flexible sheet, said multilayer thin film structure exhibiting higher transmittance at radiation wavelengths associated with said luminescent display than is exhibited at longer wavelengths, said flexible sheet and said second plurality of strips being dimensioned and arranged for mounting of said flexbile sheet in closely spaced apart, parallel relationship with said transparent backplate with said surface of said flexible sheet including said second plurality of conductive strips facing said surface of said backplate including said first plurality of conductive strips and with said second plurality of conductive strips being substantially perpendicular to said first plurality of conductive strips, said flexible sheet further including a plurality of bead-like regions formed on said surface of said pliant sheet that include said second plurality of conductive strips and extending outwardly therefrom, said plurality of bead-like regions being arranged in a pattern that positions a first portion of said plurality of bead-like regions between adjacent ones of the conductive strips of said second plurality of conductive strips and positions a second portion of said bead-like regions in alignment with the separation between adjacent ones of said first plurality of conductive strips when said flexible sheet is mounted in said parallel, closely spaced orientation with said backplate; and means for supporting and maintaining said flexible sheet in said parallel, closely spaced orientation with said surface of said backplate that includes said first plurality of conductive strips.

17. The transparent switch array of claim 16 wherein said means for supporting and maintaining said flexible sheet in said parallel, closely spaced orientation with said backplate includes a flat electrical cable having a plurality of substantially parallel spaced apart conductors extending along one planar surface thereof, said cable being interposed between at least two edge regions of said backplate and said flexible sheet, each of said conductors of said cable being arranged for electrically contacting a conductive strip within one of said first and second pluralities of conductive strips.

18. The transparent switch array of claims 16, 17, 12 or 13 wherein said plurality of bead-like regions of said pliant sheet are formed of a low temperature curing organo-silicon elastomer.

19. The transparent switch of claim 18 wherein said bead-like regions are deposited on said flexible sheet by means of a silk-screen process.

20. The transparent switch array of claim 19 wherein said organo-silicon elastomer is transparent and exhibits a coefficient of diffraction that is substantially equal to the square root of the coefficient of diffraction exhibited by said flexible sheet.

21. A transparent switch array for mounting on the face of a display device that generates luminescent display characters, said transparent switch array comprising:

a relatively transparent flexible sheet having a first plurality of substantially conductive strips formed on one surface thereof, each of said substantially parallel conductive strips being a multilayer thin film structure including a surface layer of tin-indium oxide, a second layer of an electrically conductive material and a bottom layer of material that causes said layer to adhere to said surfaces of said backplate and said flexible sheet, said multilayer thin film structure exhibiting higher transmittance at radiation wavelengths associated with said luminescent display than is exhibited at longer wavelengths;

a relatively transparent backplate having a second plurality of substantially parallel conductive strips formed on one surface thereof, each of said substantially parallel conductive strips being a multilayer thin film structure including a surface layer of tin-indium oxide, a second layer of an electrically conductive material and a bottom layer of material that causes said conductive layer to adhere to said surfaces of said backplate and said flexible sheet, said multilayer thin film structure exhibiting higher transmittance at radiation wavelengths associated with said luminescent display than is exhibited at longer wavelengths, said backplate and said second plurality of strips being dimensioned and arranged for mounting of said flexible sheet in closely spaced apart, parallel relationship with said backplate with said surface of said flexible sheet including said first plurality of conductive strips facing said surface of said backplate including said second plurality of conductive strips and with said first plurality of conductive strips being substantially perpendicular to said second plurality of conductive strips, said backplate further including a plurality of bead-like regions formed on said surface of said backplate that include said second plurality of conductive strips and extending outwardly therefrom, said plurality of bead-like regions being arranged in a pattern that positions a first portion of said plurality of bead-like regions between adjacent ones of the conductive strips of said second plurality of conductive strips and positions a second portion of said beadlike regions in alignment with the separation between adjacent ones of said first plurality of conductive strips when said flexible sheet is mounted in said parallel, closely spaced orientation with said backplate; and means for supporting and maintaining said flexible sheet in said parallel closely spaced orientation with said surface of said backplate that includes said first plurality of conductive strips.

22. The transparent switch array of claim 21 wherein said multilayer thin film structure includes a surface layer of tin-indium oxide, a second layer of gold and a bottom layer of titanium dioxide.

23. The transparent switch array of claim 22 wherein said tin-indium oxide layer is approximately 150 to 500 angstroms in thickness, said gold layer is approximately 40 to 120 angstroms in thickness and said titanium dioxide layer is approximately 75 to 150 angstroms in thickness.

24. The transparent switch array of claim 21 wherein said means for supporting and maintaining said flexible sheet in said parallel, closely spaced orientation with said backplate includes a flat electrical cable having a plurality of substantially parallel spaced apart conductors extending along one planar surface thereof, said cable being interposed between at least two edge regions of said backplate and said flexible sheet, each of said conductors of said cable being arranged for electrically contacting a conductive strip within one of said first and second pluralities of conductive strips.

25. The transparent switch array of claims 21, 22, 23, or 24 wherein said plurality of bead-like regions of said pliant sheet are formed of a low temperature curing organo-silicon elastomer.

26. The transparent switch of claim 25 wherein said bead-like regions are deposited on said flexible sheet by means of a silk-screen process.

27. The transparent switch array of claim 26 wherein said organo-silicon elastomer is transparent and exhibits a coefficient of diffraction that is substantially equal to the square root of the coefficient of diffraction exhibited by said flexible sheet.

* * * * *